US009486691B1

(12) United States Patent
McGee

(10) Patent No.: US 9,486,691 B1
(45) Date of Patent: Nov. 8, 2016

(54) FOLDABLE NET SHIELD FOR A GARAGE DOOR

(71) Applicant: Kelvin McGee, Bakersfield, CA (US)

(72) Inventor: Kelvin McGee, Bakersfield, CA (US)

( * ) Notice: Subject to any disclaimer, the term of this patent is extended or adjusted under 35 U.S.C. 154(b) by 0 days.

(21) Appl. No.: 14/662,473

(22) Filed: Mar. 19, 2015

(51) Int. Cl.
*A63B 71/02* (2006.01)

(52) U.S. Cl.
CPC ..... *A63B 71/022* (2013.01); *A63B 71/023* (2013.01)

(58) Field of Classification Search
CPC .. A63B 71/022; A63B 71/02; A63B 71/023; E06B 9/0692; A47G 5/00
See application file for complete search history.

(56) References Cited

U.S. PATENT DOCUMENTS 1,595,929 A * 8/1926 Rhodes ..... A47G 5/00 160/135
1,655,515 A * 1/1928 Simpson ..... A47G 5/00 108/38
3,215,432 A 11/1965 Lee et al.
4,290,602 A * 9/1981 Kennedy ..... E04H 17/04 256/23
5,007,645 A 4/1991 Weigl et al.
5,205,564 A 4/1993 Lamberti et al.
5,402,988 A * 4/1995 Eisele ..... E01F 13/022 160/351
5,876,291 A * 3/1999 Dubose ..... A63B 63/00 473/197
5,947,831 A * 9/1999 McCarthy ..... A63B 63/00 473/197
6,416,431 B1 * 7/2002 Keehn, Sr. ..... A63B 69/0071 473/451
7,244,199 B1 * 7/2007 Romano ..... A63B 71/022 273/127 R
2006/0040769 A1 * 2/2006 McNulty ..... A63B 69/0071 473/431
2007/0107853 A1 * 5/2007 Hsieh ..... A47G 5/00 160/135
2007/0176370 A1 * 8/2007 Cho ..... A63B 71/022 273/410
2015/0321062 A1 * 11/2015 Tyndall ..... F16M 11/28 473/456

* cited by examiner

*Primary Examiner* — Blair M Johnson
(74) *Attorney, Agent, or Firm* — Crossley & Stevenson Intellectual Property Law

(57) ABSTRACT

A foldable net shield for an entire garage door including a single rebound net connected to a frame by sleeves and spaced apart poles pivotably conjoined at forwardly and rearwardly foldable hinge assemblies on each of an upper and a lower portion of the frame. A foldable leg assembly is disposed on the lower portion of the frame proximal at least at each of a right and a left side of the frame. A brace on a rear end of the frame at least at a pair of the rearward hinge assemblies and each foldable leg assembly brace the frame against the garage door and provide space between the respective hinge and leg assembly and the garage door to prevent damage to the garage door upon impact of an object, such as a basket ball, with the rebound net. A joint is disposed on each pole.

7 Claims, 6 Drawing Sheets

FOLDABLE NET SHIELD FOR A GARAGE DOOR

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of sports practice nets devised for ball rebound and also to protect a garage door from damage caused by a ball are known in the prior art. However, what is needed is a foldable net shield close in dimension to a garage door's size that includes a single rebound net connected to a frame by sleeves and a plurality of spaced apart poles pivotably conjoined at forwardly foldable and rearwardly foldable hinge assemblies on each of an upper and a lower portion of the frame. A foldable leg assembly is disposed on the lower portion of the frame proximal at least at each of a right and a left side of the frame. A brace perpendicularly disposed on a rear end of the frame at least at a pair of rearward hinge assemblies and each foldable leg assembly brace the frame against the garage door and to provide space between the garage door and the frame and net to prevent damage to the garage door upon impact of an object, such as a basket ball, traveling at high velocity with the rebound net. A joint is centrally disposed on each pole.

FIELD OF THE INVENTION

The present invention relates to sports practice nets, and more particularly, to a foldable net shield for a garage door.

SUMMARY OF THE INVENTION

The general purpose of the present foldable net shield for a garage door, described subsequently in greater detail, is to provide a foldable net shield for a garage door which has many novel features that result in a foldable net shield for a garage door which is not anticipated, rendered obvious, suggested, or even implied by prior art, either alone or in combination thereof.

To accomplish this, the foldable net shield for a garage door includes a continuous foldable frame to which a single rebound net is attached and which has a fully extended condition to protect an entire garage door and an alternate folded condition. Spaced apart poles continuously disposed between and perpendicular to top and bottom portions of the frame support and strengthen the frame. A plurality of hinge assemblies permits the frame to fold forwardly and rearwardly by including a plurality of forward and rearward hinge assemblies alternatingly disposed on the poles. One hinge assembly is disposed on the frame on opposite top and bottom ends of each pole.

Each hinge assembly includes a gap in each of the frame top and bottom portions directly adjacent each of the top end and the bottom end of each pole and a C-bracket bridging each gap. The respective top end and bottom end of each pole is attached to a lower portion of the C-bracket. An opening in each C-bracket in each forward and rearward hinge assembly is directed toward a rear end and a front end, respectively, of the frame. A pivot member and a pair of detent pins is disposed through the C-bracket and the frame on each of a side of the gap. The detent pins secure the frame into the C-bracket when the frame is in the extended condition for use. A sleeve connects the rebound net to the frame between each of the hinge assemblies, continuously along each of right and left ends of the frame, and between an outermost one of the hinge assemblies and each of the right and left ends. At least one pair of foldable leg assemblies is provided to support the frame and rebound net in an upright position during use.

Braces perpendicularly disposed on the frame rear end and attached to the C-bracket at least at a pair of the rearward hinge assemblies and on each foldable leg provide space between the rebound net and the garage door to reduce impact from a object hitting the rebound net, such as a basketball, on the garage door thereby reducing potential damage to the garage door. A non-slip foot disposed on each of an external end of each brace and the distal end of each leg provides a gripping surface for each brace and each leg against the respective garage door and ground surface. A joint is centrally disposed on each pole.

Thus has been broadly outlined the more important features of the present foldable net shield for a garage door so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
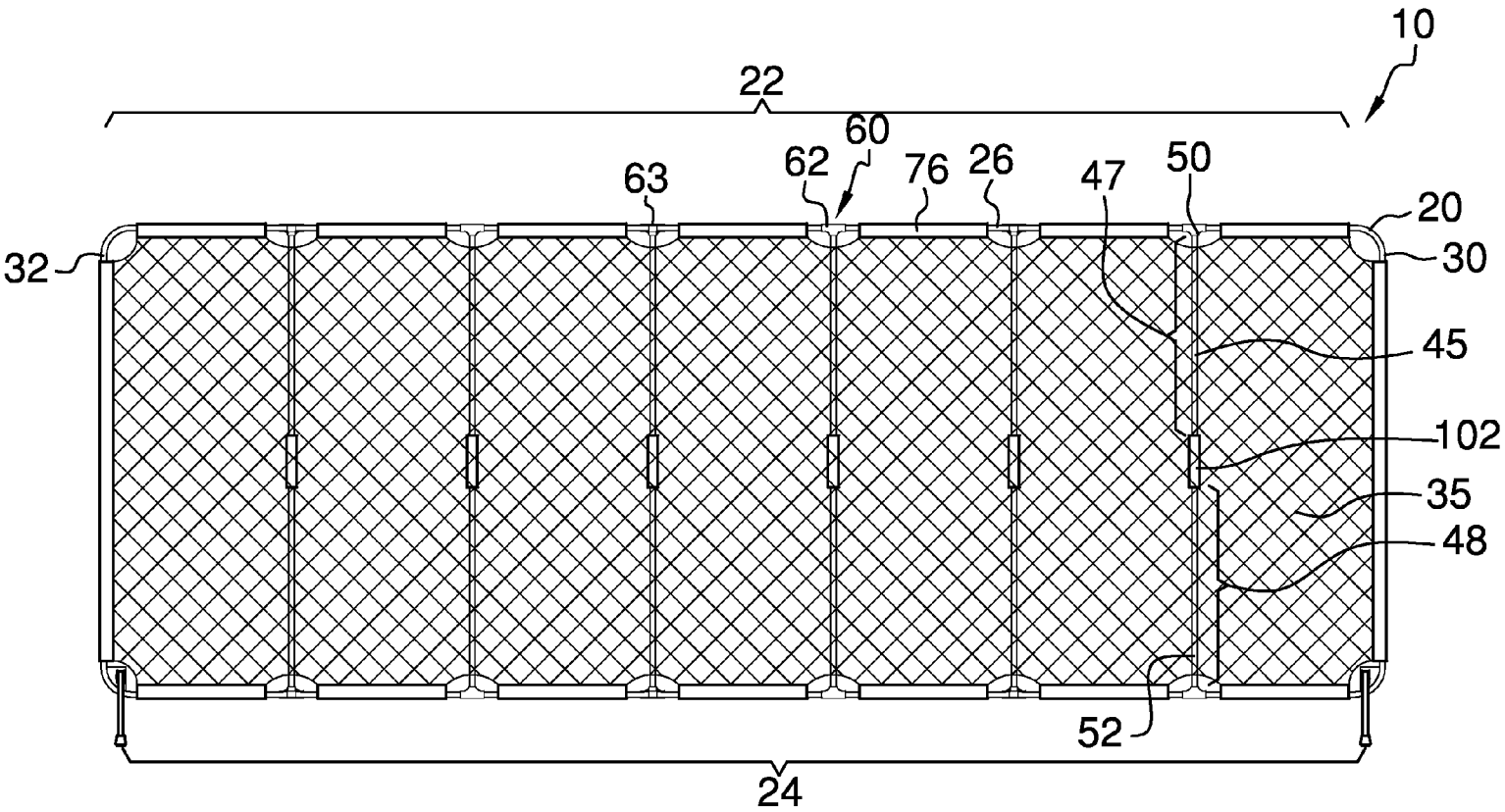
FIG. 1 is a front elevation view.
Figure 2:
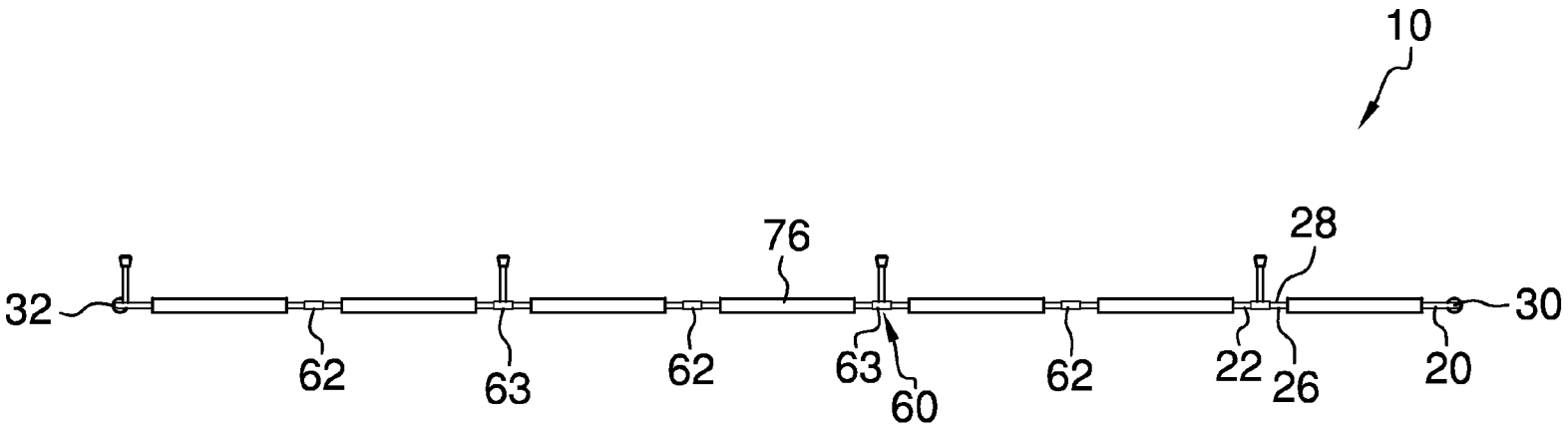
FIG. 2 is a top plan view.
Figure 3:
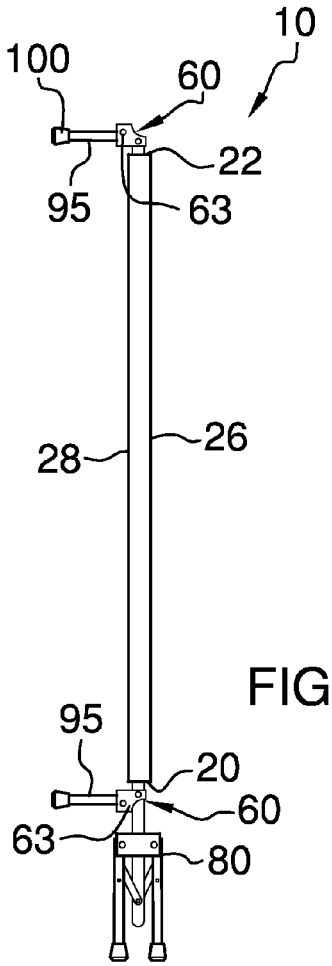
FIG. 3 is a side elevation view.
Figure 4:
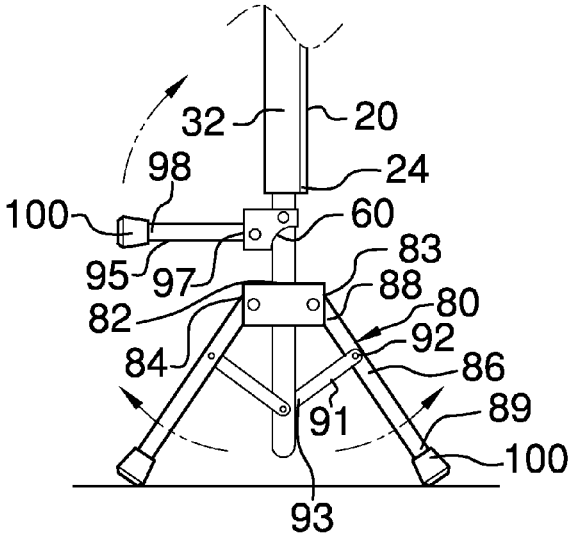
FIG. 4 is a detail view of a foldable leg assembly.
Figure 5:
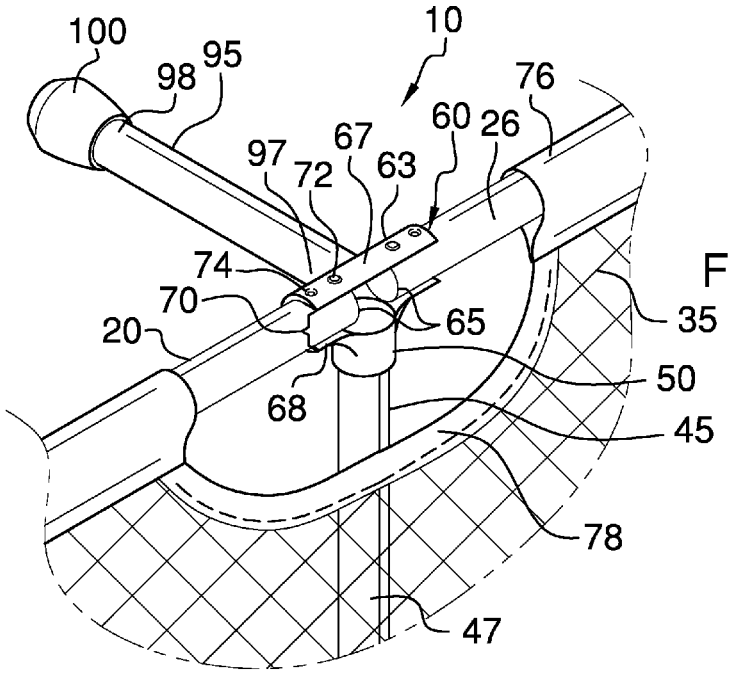
FIG. 5 is a detail view of a hinge assembly.
Figure 6:
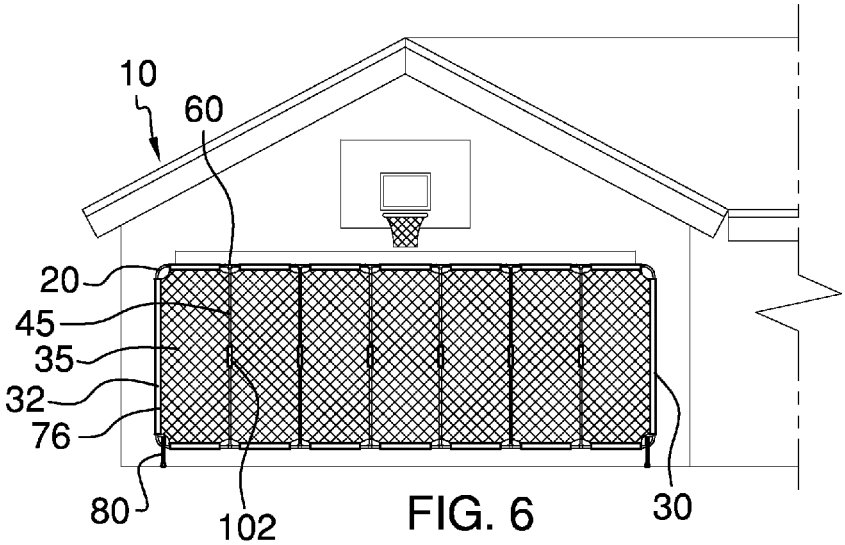
FIG. 6 is a front in-use view.
Figure 7:
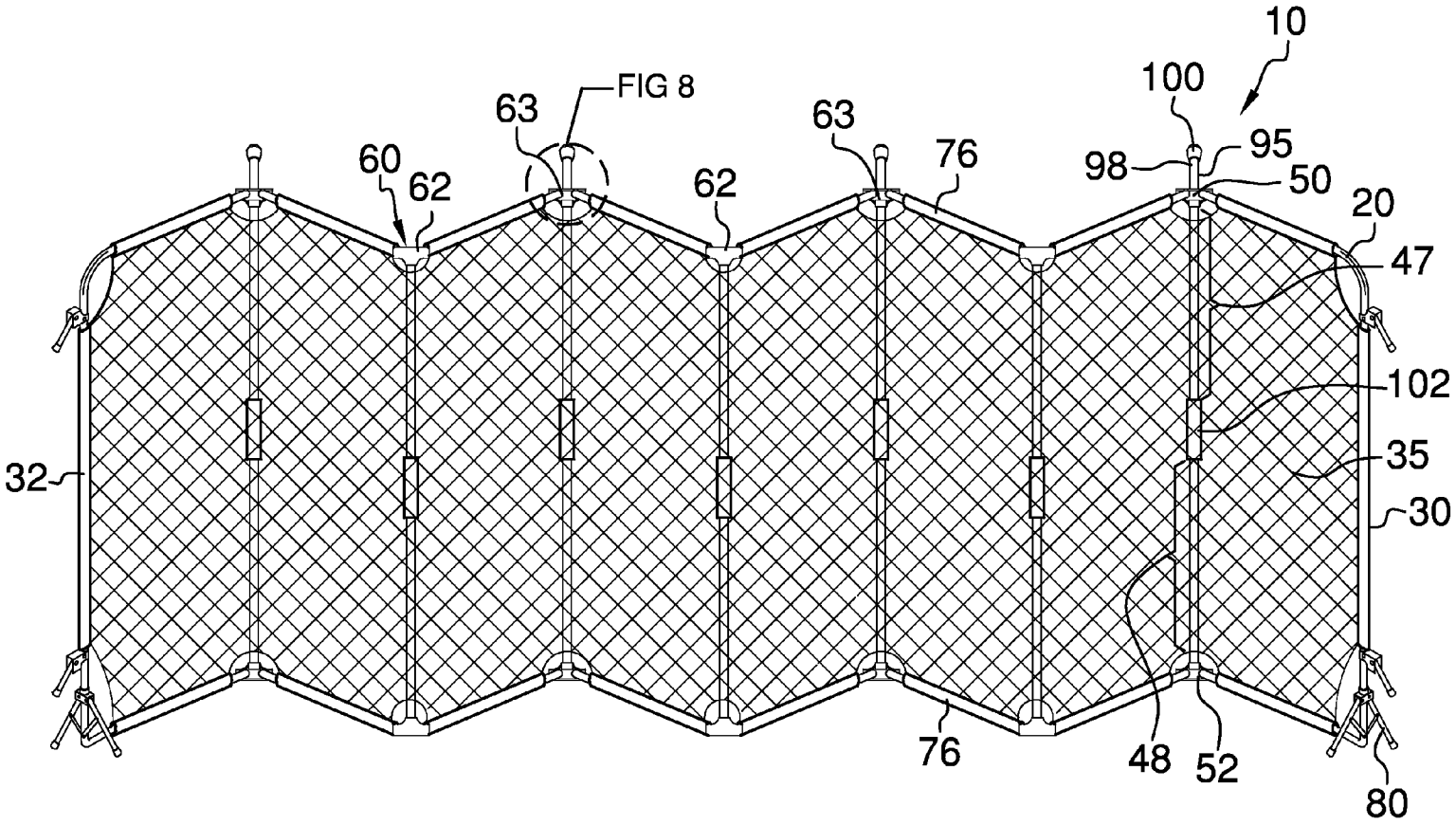
FIG. 7 is a front view in a partially folded condition.
Figure 8:
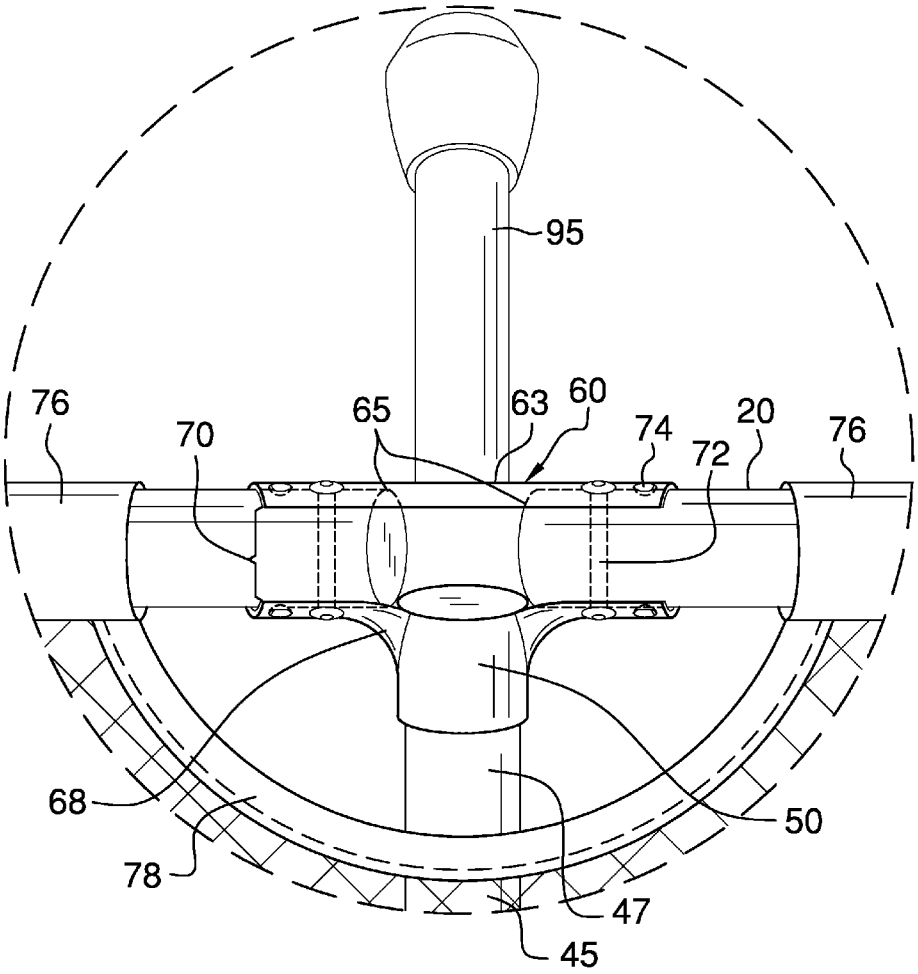
FIG. 8 is a rear detail view of a hinge assembly shown in FIG. 7.

With reference now to the drawings, and in particular FIGS. 1 through 8 thereof, an example of the instant foldable net shield for a garage door employing the principles and concepts of the present foldable net shield for a garage door and generally designated by the reference number 10 will be described.

Referring to FIGS. 1 through 8, the present foldable net shield for a garage door 10 is illustrated. The foldable net shield for a garage door 10 includes a continuous foldable frame 20. The foldable frame 20 has a top portion 22, a bottom portion 24 opposite the top portion 22 in a position parallel to the top portion 22, a front end 26, a rear end 28, a right end 30, and a left end 32. The frame 20 has a fully extended condition and an alternate folded condition. A single rebound net 35 is disposed across the entire frame 20. A plurality of spaced apart poles 45 is continuously disposed between the top portion 22 and the bottom portion 24 of the frame 20 in a position perpendicular to the top and bottom portions 22, 24. Each pole 45 has an upper section 47, a lower section 48, a top end 50, and a bottom end 52.

A plurality of hinge assemblies 60 permits the frame 20 to fold. The plurality of hinge assemblies 60 includes a plurality of forward hinge assemblies 62 and a plurality of rearward hinge assemblies 63. One of the hinge assemblies 60 is disposed on the frame 20 at each of the top and bottom ends 50, 52 of each pole 45. The forward hinge assemblies 62 and the rearward hinge assemblies 63 are alternatingly disposed on the poles 45. The frame 20 is foldable forwardly at each forward hinge assembly 62 and is foldable rearwardly at each rearward hinge assembly 63. Each hinge assembly 60 includes a gap 65 in each of the frame 20 top and bottom portions 22, 24 directly adjacent each of the top end 50 and the bottom end 52 of each pole 45. Each hinge assembly 60 has a C-bracket 67 bridging each gap 65. The respective top end 50 and bottom end 52 of each pole 45 is attached to a lower portion 68 of the C-bracket 67. An opening 70 is provided in each C-bracket 67. The opening 70 in each forward hinge assembly 62 is directed toward the rear end 28 of the frame 20, while the opening 70 in each rearward hinge assembly 63 is directed toward the front end 26 of the frame 20. A pivot member 72 is disposed through the C-bracket 67 and the frame 20 on each of a side of the gap 65. Thus, the frame 20 of each side of the gap 65 is pivotable forwardly and rearwardly at each forward hinge assembly 62 and each rearward hinge assembly 63 respectively. A pair of detent pins 74 is disposed on each of the sides of the gap 65 through the frame 20 and into each C-bracket 67 to secure the frame 20 into the C-bracket 67 when the frame 20 is in the extended condition for use.

A sleeve 76 connects the rebound net 35 to the frame 20 between each of the hinge assemblies 60, continuously along each of the right end 30 and the left end 32, and between an outermost one of the hinge assemblies 60 and each of the right end 30 and left end 32. The sleeves 76 secure the rebound net 35 to the frame 20 and strengthen the attachment of the rebound net 35 to the frame 20. A band 78 attaches each of a pair of the sleeves together at each hinge assembly 60 so that the hinge assemblies 60 can fold. The rebound net 35 in the extended condition has a height and a width substantially equal to a height and a width of a garage door.

At least one pair of foldable leg assemblies 80 is provided. One leg assembly 80 is disposed on the frame 20 bottom portion 24 proximal each of the right and left ends 30, 32. Each leg assembly 80 includes an attachment bracket 82, which is disposed on the frame 20 and has a forward side 83 disposed proximal the frame 20 front end 26 and a rearward side 84 disposed proximal the frame 20 rear end 28. In addition, each leg assembly 80 includes a leg 86 pivotably disposed on each of the forward side 83 and the rearward side 84. Each leg 86 has a proximal end 88 pivotably attached to the attachment bracket 82 and a distal end 89. A pivot arm 91 pivotably conjoins each leg 86 to the frame 20. Each pivot arm 91 has an exterior end 92 disposed on the leg 86 in a position more proximal the distal end 89 than the attachment bracket 82 and an interior end 93 disposed on the frame 20 more proximal the distal end 89 than the attachment bracket 82.

A plurality of braces 95 is provided to provide space between the rebound net 35 and the garage door being protected by the rebound net 35 and, thus, reduces impact from an object hitting the rebound net 35, such as a basketball, on the garage door thereby reducing potential damage to the garage door. One of the braces 95 is disposed on the rear end 28 of the frame 20 at least at a pair of rearward hinge assemblies 63 and on each foldable leg assembly 80 in a position perpendicular to the frame 20. Each brace 95 has an internal end 97 centrally attached to the C-bracket 67 and an external end 98. A non-slip foot 100 is disposed on each of the external end 98 of each brace 95 and the distal end 89 of each leg 86 to provide a gripping surface for each brace 95 and each leg 86 against the respective garage door and ground surface.

The present device also includes a joint 102 centrally disposed on each pole 45 between the upper section 47 and the lower section 48.

What is claimed is:

1. A foldable net shield for a garage door comprising:

a continuous foldable frame having a top portion, a bottom portion opposite the top portion in a position parallel to the top portion, a front end, a rear end, a right end, a left end, wherein the frame has a fully extended condition and an alternate folded condition;

a single rebound net disposed across the entire frame;

a plurality of spaced apart poles continuously disposed between the top portion and the bottom portion of the frame in a position perpendicular to the top and bottom portions;

a plurality of hinge assemblies comprising a plurality of forward hinge assemblies and a plurality of rearward hinge assemblies, one of the hinge assemblies disposed on the frame at each of the top and bottom ends of each pole, wherein the forward hinge assemblies and the rearward hinge assemblies are alternatingly disposed on the poles, wherein the frame is foldable forwardly at each forward hinge assembly, wherein the frame is foldable rearwardly at each rearward hinge assembly;

at least one pair of foldable leg assemblies, wherein one leg assembly is disposed on the frame bottom portion proximal each of the left and right ends;

a plurality of braces, one of the braces being disposed on the rear end of the frame at least at a pair of the rearward hinge assemblies and on each foldable leg assembly in a position perpendicular to the frame, each brace having an external end; and a non-slip foot disposed on the external end of each brace and the distal end of each of a leg of the foldable leg assemblies;

wherein the rebound net in the extended condition has a height and a width substantially equal to a height and a width of a garage door.

2. The foldable net shield for a garage door of claim 1 further comprising:

an upper section and a lower section of each pole; and a joint centrally disposed on each pole between the upper section and the lower section.

3. The foldable net shield for a garage door of claim 1 wherein each leg assembly comprises:

a bracket disposed on the frame, the bracket having a forward side disposed proximal the frame front end and a rearward side disposed proximal the frame rear end;

wherein each leg is pivotably disposed on each of the forward side and the rearward side, each leg having a proximal end pivotably attached to the bracket and a distal end; and a pivot arm pivotably conjoining each leg to the frame, each pivot arm having an exterior end disposed on the leg in a position more proximal the distal end than the bracket and an interior end disposed on the frame more proximal the distal end than the bracket.

4. The foldable net shield for a garage door of claim 2 wherein each leg assembly comprises:

a bracket disposed on the frame, the bracket having a forward side disposed proximal the frame front end and a rearward side disposed proximal the frame rear end;

wherein each leg is pivotably disposed on each of the forward side and the rearward side, each leg having a proximal end pivotably attached to the bracket and a distal end; and a pivot arm pivotably conjoining each leg to the frame, each pivot arm having an exterior end disposed on the leg in a position more proximal the distal end than the bracket and an interior end disposed on the frame more proximal the distal end than the bracket.

5. A foldable net shield for a garage door comprising:

a continuous foldable frame having a top portion, a bottom portion opposite the top portion in a position parallel to the top portion, a front end, a rear end, a right end, a left end, wherein the frame has a fully extended condition and an alternate folded condition;

a single rebound net disposed across the entire frame;

a plurality of spaced apart poles continuously disposed between the top portion and the bottom portion of the frame in a position perpendicular to the top and bottom portions, each pole having an upper section, a lower section, a top end, and a bottom end;

a plurality of hinge assemblies comprising a plurality of forward hinge assemblies and a plurality of rearward hinge assemblies, one of the hinge assemblies disposed on the frame at each of the top and bottom ends of each pole, wherein the forward hinge assemblies and the rearward hinge assemblies are alternatingly disposed on the poles, wherein the frame is foldable forwardly at each forward hinge assembly, wherein the frame is foldable rearwardly at each rearward hinge assembly, each hinge assembly comprising:

a gap in each of the frame top and bottom portions directly adjacent each of the top end and the bottom end of each pole;

a C-bracket bridging each gap, wherein the respective top end and bottom end of each pole is attached to a lower portion of the C-bracket;

an opening in each C-bracket, wherein the opening in each forward hinge assembly is directed toward the rear end of the frame, wherein the opening in each rearward hinge assembly is directed toward the front end of the frame;

a pivot member disposed through the C-bracket and the frame on each of a side of the gap;

wherein the frame of each side of the gap is pivotable forwardly and rearwardly at each forward hinge assembly and each rearward hinge assembly respectively;

a sleeve connecting the rebound net to the frame between each of the hinge assemblies, continuously along each of the right end and the left end, and between an outermost one of the hinge assemblies and each of the right end and left end;

a band attaching each of a pair of the sleeves together at each hinge assembly wherein the band is configured to permit the hinge assemblies to fold;

at least one pair of foldable leg assemblies, wherein one leg assembly is disposed on the frame bottom portion proximal each of the left and right ends, each leg assembly comprising:

an attachment bracket disposed on the frame, the attachment bracket having a forward side disposed proximal the frame front end and a rearward side disposed proximal the frame rear end;

a leg pivotably disposed on each of the forward side and the rearward side, each leg having a proximal end pivotably attached to the attachment bracket and a distal end;

a pivot arm pivotably conjoining each leg to the frame, each pivot arm having an exterior end disposed on the leg in a position more proximal the distal end than the attachment bracket and an interior end disposed on the frame more proximal the distal end than the attachment bracket;

a plurality of braces, one of the braces being disposed on the rear end of the frame at each rearward hinge assembly and on each foldable leg assembly in a position perpendicular to the frame, each brace having an internal end centrally attached to the C-bracket and an external end; and a non-slip foot disposed on each of the external end of each brace and the distal end of each leg;

wherein the rebound net in the extended condition has a height and a width substantially equal to a height and a width of a garage door.

6. The foldable net shield for a garage door of claim 5 further comprising:

a joint centrally disposed on each pole between the upper section and the lower section.

7. The foldable net shield for a garage door of claim 6 further comprising:

a pair of detent pins on each of the sides of the gap, the detent pins being disposed through the frame and into each C-bracket.

* * * * *